US006271456B1

(12) United States Patent
Nelson

(10) Patent No.: US 6,271,456 B1
(45) Date of Patent: Aug. 7, 2001

(54) TRANSDUCER AND MUSICAL INSTRUMENT EMPLOYING THE SAME

(76) Inventor: Gary A. Nelson, 20708 Deerpath Rd., Suite 1B, Barrington, IL (US) 60010

( * ) Notice: Subject to any disclaimer, the term of this patent is extended or adjusted under 35 U.S.C. 154(b) by 0 days.

(21) Appl. No.: 09/394,578

(22) Filed: Sep. 10, 1999

(51) Int. Cl.[7] ..... G10H 3/18
(52) U.S. Cl. ..... 84/726; 84/734
(58) Field of Search ..... 84/725–728, 735, 84/736, 741, 729, 734

(56) References Cited

U.S. PATENT DOCUMENTS

| | | | | |
|---|---|---|---|---|
| 2,683,388 | * | 7/1954 | Keller | 84/727 |
| 3,541,219 | * | 11/1970 | Abair | 84/727 |
| 4,133,243 | * | 1/1979 | DiMarzio | 84/727 |
| 4,370,523 | | 1/1983 | Bäder | 179/1 |
| 5,051,799 | | 9/1991 | Paul et al. | 375/25 |
| 5,121,669 | * | 6/1992 | Iba et al. | 84/735 |
| 5,459,283 | | 10/1995 | Birdwell, Jr. | 84/737 |
| 5,567,903 | | 10/1996 | Coopersmith et al. | 84/723 |

FOREIGN PATENT DOCUMENTS

| | | | | |
|---|---|---|---|---|
| 257 706 | * | 6/1988 | (DE) | 84/727 |

* cited by examiner

*Primary Examiner*—Stanley J. Witkowski
(74) *Attorney, Agent, or Firm*—Laff, Whitesel & Saret, Ltd.

(57) ABSTRACT

An electrical pickup for use with a stringed musical instrument is disclosed, as well as a stringed musical instrument employing such a pickup. The pickup is formed of a plurality of magnetoresistive elements, whose electrical resistance decreases as the magnitude of a surrounding magnetic field increases. A first pair of the magnetoresistive elements form two opposite legs of a Wheatstone bridge, and a second pair forms the remaining legs. The magnetoresistive elements forming the two pairs are electrically opposite one another, but are physically located side by side. The first pair is located on a first side of the vibrating string, and the second pair is located on the other side. A magnetic field is established which interacts with the magnetoresistive elements. The pickup is positioned so that the vibration of the string causes perturbations in the magnetic field, which in turn alter the resistance of the magnetoresistive elements. When a DC voltage is applied across the input terminals of the Wheatstone bridge, an output voltage signal is developed across the output terminals that varies with the changing resistance of the magnetoresistive elements. Because the resistance of the magnetoresistive elements changes with the instantaneous position of the vibrating string, the output voltage is representative of the vibration of the string.

30 Claims, 6 Drawing Sheets

TRANSDUCER AND MUSICAL INSTRUMENT EMPLOYING THE SAME

BACKGROUND OF THE INVENTION

The present invention relates to a stringed instrument, such as a guitar, employing an improved electrical pickup.

Stringed instruments generate sound by the controlled vibration of the strings. The latter vibrate at different frequencies to generate notes of varying pitch. On most acoustical instruments, the strings are placed on or near a hollow sound chamber or sound board which combines and amplifies the sound waves to create the full rich tones that music lovers have enjoyed for centuries.

This century, however, has seen the rise of electrical musical instruments, most notably the electric guitar and the electric bass. On such instruments, the function of the hollow sound chamber is replaced by an electric power amplifier. Electrical transducers called "pickups" are placed on the instrument to sense the vibration of the strings and convert the vibrational energy into an electrical signal. This signal is then boosted by the amplifier and broadcast over a loud speaker. The electrical pickup is thus a key component: the more accurately the output signal follows the vibration of the strings, the more true will be the sound reproduced by the loudspeaker.

Most stringed instruments, such as guitars, have more than one string. It is desirable that in order to more faithfully reproduce the sound of the instrument, the vibration of each string should be separately transduced and amplified. However cost, size, and other design considerations have generally dictated that electric instruments have a smaller number of electrical pickups than the number of strings on the instrument. Electric guitars and electric basses, for example, typically employ an elongated electric coil type pickup that spans the width of all four to twelve strings of the instrument, resulting in a composite signal that represents the vibration of all the strings. Such pickups are generally incapable of sensing the full range of harmonic tones generated by all of the strings. The result is that the pickup introduces its own qualities to the signal transduced from the vibrating strings, and as a result the sound reproduced by the loudspeaker is not a true representation of the acoustic properties of the instrument.

Electrical coil pickups are well known in the art. A coil pickup generally comprises one or more permanent magnets surrounded by a coil of wire. The magnet generates a magnetic field that passes through the pickup coil and also extends into the space occupied by the vibrating strings of the instrument. Vibration of the strings causes disturbances in the magnetic field which induce voltages within the surrounding coil. These voltages comprise the signal which is then amplified and broadcast over a loudspeaker. Thus, the pickup output signal does not actually relate directly to the motion of the strings, but rather, to the voltages induced in the coil. As a result, the sound reproduced by the loudspeaker will be affected by factors wholly unrelated to the acoustic characteristics of the instrument. Thus, the number of turns in the coil, the gauge of the wire comprising the coil, the number and position of the permanent magnets, and other factors will influence the sound of the instrument.

The sound of an electrical instrument is generally determined by the frequency response of the pickup. The pickups used today generally are high impedance devices designed to match the high input impedance of most amplifiers. That is to say, most pickups used today have an impedance in the range between 10K ohms and 60K ohms. Lower impedance pickups tend to have a good frequency response in the higher frequency ranges, but do not perform well at lower frequencies. On an electric guitar, these lower impedance pickups tend to work well when placed in the neck region of the guitar, but tend to produce a "tinny" sound when placed near the bridge. Conversely, pickups having an impedance greater than about 25K ohms tend to have excellent bass response but do not perform well in the higher frequency ranges. One less-than-satisfactory solution to this problem has been to provide a set of both higher and lower impedance pickups on the same guitar, and provide means for switching between the two, depending on the type of sound desired. Ideally a pickup would respond uniformly to all vibration frequencies of the instrument, but this is not possible with coil-magnet pickups due to limitations imposed by the laws of physics.

Another problem with magnetic coil pickups is that they tend to pick up electrical noise and interference signals from extraneous sources, such as power circuits, radio and television equipment, fluorescent lighting, and the like. Two-coil pickups, known as "humbuckers" were developed to reduce the amount of noise induced on a magnetic coil pickup. The "first generation" humbucker pickup actually comprises two coils spaced apart along the length of the strings. The coils are connected with opposite electrical polarities, so that the noise signals which are electrically induced in the coils are cancelled out. The two coils, however, are arranged so that the signals from the vibrating strings are added together. While the traditional humbucker pickup is effective in reducing noise, it has a drawback in that it senses string motion from two different points along the length of the string, approximately 0.6 inches apart. Thus, the signals from each coil which are added together are slightly out of phase. This poor phase relationship degrades the output signal so that it does not accurately represent the vibration of the strings.

Various designs such as a "stacked" humbacker where the two coils are wound onto the same armature but in opposite polarities, have been implemented in an attempt to combine the superior sound characteristics of a "single coil" pickup with the hum canceling characteristics of the traditional humbacker. However, none of these approaches can circumvent the physical laws that penalize the addition of a second coil. For example, the additional turns of wire of the second coil yield more inductance and capacitance which affect the tonality of the pickup. It simply has not been possible to construct a coil pickup that measures the true string movements of a guitar and reports those movements without coloration.

Other types of electrical pickups have also been used to transduce the vibration of musical instrument strings. Electromechanical vibration sensors of the piezoelectric, strain gauge and accelerometer type have also been used as pickups on musical instruments, primarily to amplify the sound of otherwise hollow-bodied acoustic instruments. However, such electromechanical transducers have not been completely effective in faithfully converting the vibrations of the instrument strings into electrical signals. This lack of fidelity is primarily due to the nature of the mechanical coupling between the vibrating string and the electromechanical sensor. Some of these couplings are quite complex and become quite expensive to manufacture. Furthermore, with electromechanical sensors, transients developed when the strings are actuated near the sensor tend to be overemphasized, and the pickups tend to be sensitive to body noises and body resonances when the resonating body reacts against the string-contacting transducer.

Another approach which has been employed with hollow-bodied guitars has been to mount a condenser microphone within the guitar. A desirable feature of this approach is that good condenser microphones are very accurate pressure transducers, and thus produce an accurate representation of the sound of the instrument. However, this approach is not well suited for concert situations where the microphone is also likely to pick up and amplify ambient sounds unrelated to the sound of the instrument itself.

Yet another method of sensing string vibration which has been employed is to detect minute electrical currents induced in electrically conductive strings when the strings vibrate in a magnetic field. However, the magnetic field required to induce detectable current signals within the strings has a downward pulling effect on the strings, which interferes with their natural resonance. While this approach may arguably produce a more accurate representation of string motion, the effective aperture is determined by the length of string exposed to the magnetic field. Due to the pulling effect of the magnets, it is desirable to minimize the magnetic aperture. However, small aperture and large output signal level are mutually exclusive, and this scheme has not become popular.

In light of the problems with the prior art, there exists a need for an improved electrical pickup for stringed musical instruments. It is desirable that a pickup be capable of individually transducing the vibration of only a single string, and that a plurality of such pickups be provided on a multi-stringed instrument, whereby the movement of each string may be separately transduced. Such a pickup could be produced with a sensor for each string on a harp, harpsichord, piano, dulcimer, or any other multistring instrument with ferromagnetic strings.

It is further desirable that the electrical signal output from such an improved electrical pickup be a true representation of the instantaneous position of a vibrating string, so that the sound of the instrument may be accurately reproduced without sonic colorations introduced by the pickup itself.

Ideally, an improved pickup will have a very small aperture, to produce a sensor that provides the truest rendition of string motion that includes all higher harmonics.

Finally, it is desirable to provide a musical instrument incorporating a plurality of such improved electrical pickups, at least one per string, whereby the output signal from each string may be individually manipulated so that selected sound characteristics may be purposely added to or removed from the signals.

SUMMARY OF THE INVENTION

In a first aspect of the present invention, an electrical pickup or transducer is provided for use with a stringed instrument and configured to generate an electrical signal corresponding to the movement of one of the vibrating strings of the instrument as the instrument is played. The pickup is formed of a plurality of magnetoresistive elements, each having an electrical resistance that varies in the presence of a magnetic field. The resistance of the magnetoresistive elements decreases as the magnitude of the surrounding magnetic field increases. The magnetoresistive elements are electrically connected in a Wheatstone bridge configuration having a pair of input terminals and a pair of output terminals. A first pair of the magnetoresistive elements form two opposite legs of the Wheatstone bridge, and a second pair of the magnetoresistive elements form the remaining legs of the bridge. While the magnetoresistive elements forming the two pairs are electrically opposite one another, physically they are located side by side, the first pair being physically located on a first side of the vibrating string, and the second pair being physically located on a second side of the string. A magnetic field is established which interacts with the magnetoresistive elements. The magnetic field may be provided by means of a permanent magnet mounted behind the pickup, or may be generated by a current carried by the vibrating string itself. The pickup is positioned so that the vibration of the string causes perturbations in the magnetic field, which in turn alter the resistance of the magnetoresistive elements. When a DC voltage is applied across the input terminals of the Wheatstone bridge, an output voltage signal is developed across the output terminals that varies with the changing resistance of the magnetoresistive elements. Because the resistance of the magnetoresistive elements changes with the instantaneous position of the vibrating string, the output voltage is a true representation of the instantaneous position of the vibrating string. The actual aperture, the length of the sensor geometry, is approximately 0.5 mm, at least 6 to 10 times smaller than a coil-magnet pickup.

Another aspect of the invention involves an electrical musical instrument employing an improved electrical pickup. A stringed instrument comprises some type of support over which a string is stretched. The string is adapted to vibrate when acted upon by a musician, and thereby create sound. An electrical pickup for sensing the vibration of the string includes first and second giant magnetoresistive elements located on a first side of the string, and third and fourth giant magnetoresistive elements located on a second side of said string. Electrically the giant magnetoresistive elements are arranged in a Wheatstone bridge configuration. A DC voltage source is connected across a pair of input terminals formed at the junctions between the first and second giant magnetoresistive elements, and the third and fourth giant magnetoresistive elements, respectively. Output terminals are formed at the junction between the first and third giant magnetoresistive elements and the junction between the second and fourth giant magnetoresistive elements. A magnetic field is provided which is oriented in a manner designed to interact with the giant magnetoresistive elements. When the instrument string vibrates, these vibrations create perturbations in the magnetic field, causing the resistance of the giant magnetoresistive elements to change. As the resistance of the various legs of the Wheatstone bridge changes, a variable voltage output signal is developed across the output terminals of the bridge. The instantaneous magnitude of the output voltage signal corresponds to the instantaneous position of the vibrating string. A differential amplifier is provided for amplifying the output voltage signal.

Yet another aspect of the invention is an improved electric guitar. The guitar includes a plurality of electrical pickups at least equal in number to the number of strings on the guitar. Each pickup is positioned to individually sense the vibration of one of the strings, and generates an independent electrical signal corresponding to the vibration thereof. The guitar further includes means for transmitting each of said electrical signals from the guitar to external amplification or recording equipment.

DETAILED DESCRIPTION OF THE PREFERRED EMBODIMENTS

A first aspect of the present invention relates to an improved electrical pickup, or transducer, for detecting the movement of a vibrating string such as a guitar or violin string. The electrical pickup senses the vibration of the string and generates a high fidelity variable voltage signal representative of the instantaneous position of the string. The instrument may be supplied with a plurality of such pickups, equal to the number of strings on the instrument. Thus, a separate electrical signal may be generated corresponding to the vibration of each string on the instrument, allowing independent processing of each signal by external equipment such as amplifiers, mixers, and other sound reproducing equipment.

The pickup of the present invention relies on a plurality of magnetoresistive elements. Magnetoresistive devices are thin-film devices generally comprising alternating layers of magnetic and non-magnetic material. Such devices generally have a high electrical resistance that changes in the presence of magnetic fields. Several different types of magnetoresistive devices are known, including anisotropic magnetoresistive devices (AMR), giant magnetoresistive devices (GMR), spin valves, and spin-dependent tunneling devices (SDT). Each of the various magnetoresistive devices available have attributes such as cost, size, and sensitivity which make some devices better suited for certain applications than others. In the present case, it has been found that GMR devices perform best in the electrical pickup of the present invention, though it is possible that advances in other magnetoresistive technologies may render other types of magnetoresistive devices equally well suited for this application in the future.

Figure 1:
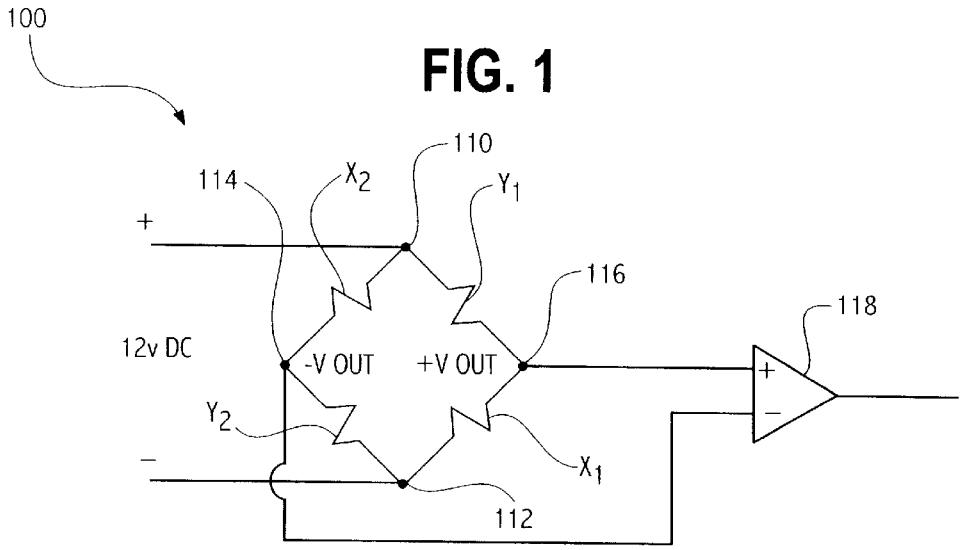
FIG. 1 is schematic diagram of an electrical pickup according to a first embodiment of the invention.
Figure 2:
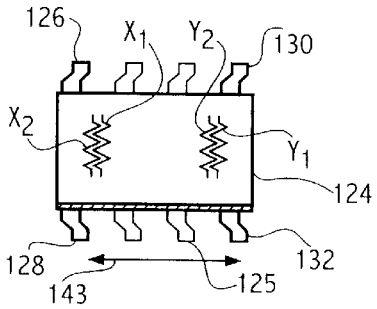
FIG. 2 is a plan view of a GMR magnetic field gradient sensor used in the pickup of FIG. 1.

Referring to FIGS. 1 and 2, FIG. 1 shows a schematic electrical circuit diagram of an electrical pickup 100 according to a first embodiment of the invention, and FIG. 2 shows a plan view of a magnetic field gradient sensor employed within pickup 100. The electrical pickup comprises a magnetic field gradient sensor such as the AB0001 series manufactured by NonVolatile Electronics, Inc. (NVE) of Eden Prairie, Minn. The gradient magnetic field sensor is a solid state device generally comprising four GMR resistors $X_{1,\ Y1,\ X2,\ Y2}$ connected in a Wheatstone bridge configuration. A DC voltage, for example +12v, is applied between a positive input terminal 110 formed at the junction between resistors $X_{2,\ Y1}$, and a negative DC input terminal 112 formed at the junction between resistors $X_1$, $Y_2$. An output voltage signal is developed across the output terminals 114, 116 formed at the junctions between resistors $X_1$, $Y_1$, and $X_2$, $Y_2$ respectively. The output terminals 114, 116 are connected as inputs to a differential amplifier 118, the output of which comprises the output of the pickup. The sensor and amplifier can be constructed to work equally well on a signal supply voltage, or using +V and −V supplies.

The magnetic field gradient sensor comprises four GMR resistors formed on a silicon wafer housed in an typical integrated circuit package 124. External leads, or pins 125 provide connection points whereby the magnetic field gradient sensor may be soldered, plugged into, or otherwise mounted on a printed circuit board. Pins 126 and 128 correspond to the positive and negative input terminals of the Wheatstone bridge circuit, and pins 130 and 132 correspond to the positive and negative output terminals. Schematically, FIG. 1 shows resistors $X_1$, $X_{2,\ Y1}$, $Y_2$ electrically connected in a symmetrical diamond pattern which is the common representation of a Wheatstone bridge. Physically, however, the resistors are formed in pairs on each side of the chip, as indicated in FIG. 2. As can be seen, resistors forming opposite legs of the Wheatstone bridge are grouped together. Thus, electrically opposite resistors $X_1$, $X_2$ are shown physically together on the left of the chip package, and electrically opposite resistors $Y_1$, $Y_2$ are shown physically together on the right.

The gradient magnetic field sensor operates by detecting minute differences in magnetic field strength at each end of the chip package 124. Resistors $X_1$, $X_2$, $Y_1$, and $Y_2$ are formed having approximately the same quiescent resistance; however, their resistance decreases in the presence of an external magnetic field. Thus, in the absence of a magnetic field, or in the presence of a uniform magnetic field affecting each of the GMR resistors in the same way, resistors $X_1$, $X_2$, $Y_1$, and $Y_2$ will all have substantially the same resistance. If the applied magnetic field is non-uniform, however, and is stronger for example, on the side of chip package 124 containing resistors $X_1$, $X_2$, their resistance will be reduced relative to that of resistors $Y_1$, $Y_2$. Under these circumstances the Wheatstone bridge becomes unbalanced.

With a constant DC voltage applied across the input terminals 110, 112 of the Wheatstone bridge, a variable output voltage signal is developed across output terminals 114, 116 as the magnetic field gradient changes. The output voltage signal will vary with the changing resistance of the GMR resistors $X_1$, $X_2$, $Y_1$, and $Y_2$ in response to variations in the external magnetic field gradient. Again, assuming that the external magnetic field is stronger on the "X" side of the chip package 124, and that the resistance of resistors $X_1$, $X_2$ has been reduced below that of resistors $Y_1$, $Y_2$, the voltage drop across resistors $X_1$ and $X_2$ will be less than the voltage drop across $Y_1$ and $Y_2$. As a result, the voltage present at the positive output terminal 114 will be less than the voltage at the negative output terminal 116, thus giving rise to a negative sensor output voltage.

Conversely, if the magnetic field is stronger on the $Y_1$, $Y_2$ side of the chip package, the resistance of, and therefore the voltage drop across, resistors $Y_1$ and $Y_2$ will be less than that of resistors $X_1$ and $X_2$. In this case the voltage at the positive output terminal 114 will be greater than the voltage at the negative output terminal 116, giving rise to a positive sensor output signal. In either case, the magnitude of the output voltage will depend on the magnitude of the difference in the magnetic field strength from one side of the sensor chip 124 to the other.

Figure 8:
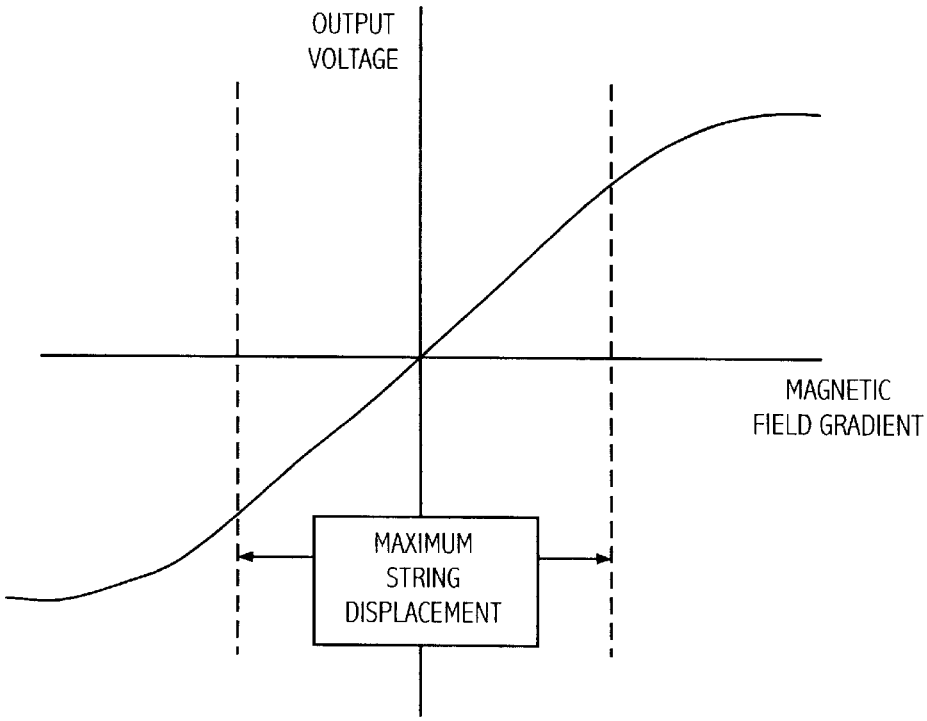
FIG. 8 is a graph showing the output characteristics of an electrical pickup according to the embodiment of FIG. 1.

FIG. 8 shows the general output characteristics of a GMR magnetic field gradient sensor. The graph shows the sensor output voltage versus magnetic field gradient applied to the X and Y resistors. The result is a bi-polar curve symmetrical about the origin. The output voltage increases in the positive direction as the magnetic field strength increases on the Y resistors, and increases in the negative direction as the magnetic field increases on the X resistors.

As will be described in more detail below, the strings of a musical instrument are formed of a ferromagnetic material that interacts with a magnetic field provided by a permanent magnet. As the instrument is played and the musician causes a string to vibrate, hysteresis and eddy currents within the ferromagnetic string cause perturbations within the magnetic field. These perturbations cause small gradients in the magnetic field applied to the GMR magnetic field gradient sensor. In the electrical pickup of the present invention the magnetic field gradient sensor is placed near one of the vibrating strings of the musical instrument, and the sensor is immersed in the magnetic field whose orientation is orthogonal to the axis of sensitivity of the GMR sensor device. As a result, vibration of the string affects the strength of the magnetic field sensed by the X and Y resistors. As the string moves in a first direction the magnetic field increases over a first pair of the resistors, and decreases over the other pair. When the string moves back in the other direction the situation is reversed: the strength of the magnetic field is increased over the second pair of resistors, and reduced over the others. The result is an output voltage signal that faithfully tracks the instantaneous position of the vibrating string.

Figure 3:
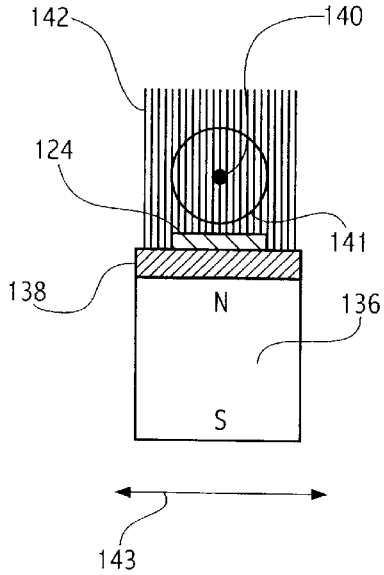
FIG. 3 is a cross-sectional view of an electrical pickup according to an embodiment of the invention including a permanent biasing magnet.

Turning to FIG. 3, in a preferred embodiment of the invention a GMR magnetic field gradient sensor 124 is mounted above a permanent magnet 136. The permanent magnet supplies a substantially uniform magnetic field across the entire sensor, as indicated by the uniformly distributed parallel magnetic flux lines 142 shown in the drawing. A pole piece 138 may be added between the magnet and the magnetic field gradient sensor 124 to concentrate the magnetic field on the GMR resistors within the sensor package and to make the field more uniform. The pickup assembly is mounted on a stringed musical instrument, directly below one of the strings 140, seen in cross-section in FIG. 3. Ideally, the sensor is positioned so that, when the string 140 is at rest, the longitudinal axis of the string bisects the GMR gradient sensor 124, with resistor pair $X_1$, $X_2$ and resistor pair $Y_1$, $Y_2$ located on opposite sides of the string and an equal distance therefrom. As the instrument is played, string 140 is caused to vibrate. The tension of the string and other physical factors limit the movement of the string and the laws of physics dictate that the string vibrates within the narrow range indicated by the circle 141. The range 141 of vibratory motion of the string 140 is entirely with the uniform magnetic field 142. The vibrating string 140 oscillates back and forth relative to the magnetic field gradient sensor along the sensor's axis of sensitivity 143.

As the string moves in a first direction, closer to resistors $Y_1$, $Y_2$, the strength of the magnetic field increases on the "Y" side of the sensor, and decreases on the "X" side of the sensor. As a result, the resistance of resistors $Y_1$ and $Y_2$ is reduced relative to the resistance of $X_1$ and $X_2$, leading to a more positive voltage on the output terminals of the sensor. The magnitude of the output voltage is determined by the amount of displacement of the string relative to the sensor. Similarly, as the string moves back in the opposite direction, the magnetic field on the "X" side of the sensor grows stronger, and magnetic field strength on the "Y" side is reduced. Thus, the resistance of resistors $X_1$ and $X_2$ is reduced relative to the resistance of $Y_1$ and $Y_2$, causing a more negative output voltage signal. In this manner, the pickup generates an output voltage signal directly related to the instantaneous position of the vibrating string 140. As a result, the sound generated by the vibrating string can be reproduced with a higher degree of fidelity than heretofore possible.

Conventional coil-magnet pickups generate an output signal that is proportional to the velocity of string movement, and not the actual string position as in the present invention. Mathematically, velocity is the derivative of position. It is well known that the frequency response of the derivative operator is directly proportional to frequency and has zero response at zero frequency. This is one reason that conventional pickups are difficult to design for lower frequencies and especially for basses. This invention is linear down to DC and simultaneously has been tested to operate to at least 1 MHz-far beyond the range of human hearing, Returning for a moment to FIG. 8, it will be apparent that musical fidelity is maximized if the central linear portion of the response curve, at both extremes, extends beyond the maximum string displacement indicated in that Figure, so that the non-linear extremes of the response curve are never reached by the string vibrations. It is believed that this condition can be more easily achieved or approached if: 1) the string is centered between resistor pair $X_1$, $X_2$ and resistor pair $Y_1$, $Y_2$; and 2) the separation between the two resistor pairs is optimized such that the spacing is as wide as possible while maintaining adequate sensitivity to small string displacements; and/or 3) the sensor is placed near one end of the string rather than in the middle of the string, so that the local maximum amplitude of vibration is less than the overall maximum amplitude, typically at mid-string; and/or 4) the spacing between the string and the sensor is minimized, provided, however, that the string must not be allowed to touch the sensor, for that would damp its vibration and distort the sound.

It will now be understood that the electrical pickup of the present invention senses the position of the vibrating string by measuring changes in the magnetic field applied to opposite sides of the GMR sensor. It is the changes in this gradient, i.e. the changes in the strength of the magnetic field along the sensor's axis of sensitivity, that generate the variable output signal.

Figure 4:
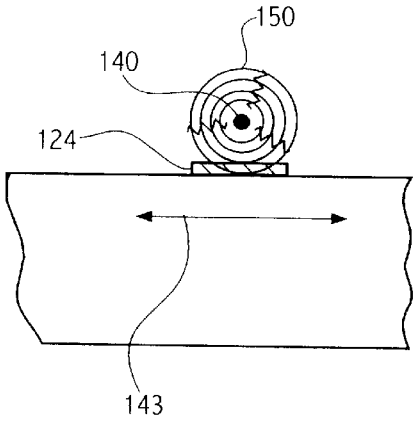
FIG. 4 is a cross-sectional view of an electrical pickup according to an embodiment of the invention wherein a magnetic field is carried by the vibrating string.

It will be also appreciated that the source of the magnetic field is immaterial. Accordingly, in alternate embodiments of the invention, the permanent biasing magnet 136 is removed and replaced by a magnetic field carried by the vibrating string 140 itself, as shown in FIG. 4. The circular magnetic field centered around the string 140 is represented by the circular flux lines 150. Rather than causing perturbations in an existing magnetic field, vibration of the string 140 actually moves the entire magnetic field relative to the sensor 124.

Though the mechanism is different, the result is the same as in the previous embodiment. The magnetic field moves with the oscillations of the vibrating string 140, causing changes in the magnetic field gradient sensed by the various GMR resistors within the sensor 124. The varying strength of the magnetic field along the axis of sensitivity 143 of the sensor alters the resistance of the GMR resistors by different amounts, causing a variable output voltage signal in the same manner as previously described. Once again, the output voltage directly tracks the instantaneous position of the string.

This embodiment requires establishing a magnetic field centered on, and carried by, the vibrating string. A first method for establishing such a field is to magnetize the strings. This can be accomplished by slowly moving a relatively large permanent magnet toward the electrically conductive string, touching the string with the magnet, then slowly moving the magnet away from the string. Once this magnetizing operation has been performed, the string will temporarily retain a magnetic field sufficient to interact with the GMR sensor as previously described. When the magnetic field has diminished to the point where the sensor can no longer detect changes in the magnetic field, the magnetizing process may be repeated.

Another method for generating a magnetic field around the vibrating string is to pass a DC electric current along the length of the string, so that a stable magnetic field is established around the string, similar to the one illustrated in FIG. 4. In this embodiment, the string 506 must be made of a material which is electrically conductive, but need not be ferromagnetic. Metallic strings are one possibility. For classical instruments that require non-conductive gut strings, however, it is possible to substitute conductive polymer strings having sonic qualities similar to those of gut or nylon strings.

Figure 5:
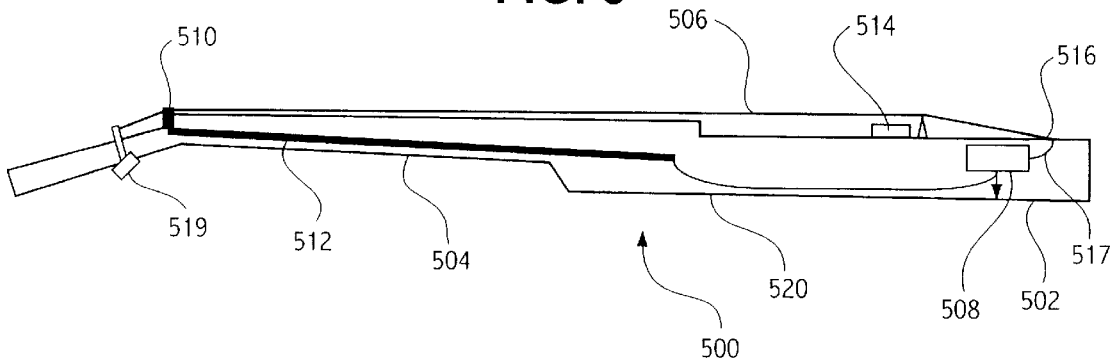
FIG. 5 is a side view of a guitar according to an embodiment of the invention.

FIG. 5 shows a guitar including provisions for supplying a current along the length of a guitar string. (A guitar was chosen for purposes of illustration only, and the invention is not limited to guitar strings.) The guitar 500 has a body 502, a neck 504, and a string 506. A pickup assembly 514 according to the present invention is mounted to the body 502 directly below string 506. A power supply 508 is provided to supply the electrical current. As will be discussed further below, the power supply 508 may be a battery assembly, or a transformer, rectifier and voltage regulator for converting an externally supplied AC voltage, or some other conventional source for supplying a voltage along the length of the string. The string 506 is stretched across the neck and body of the guitar. A first end of the string is fastened to the body of the guitar at 516, where an electrical conductor 517 attached to the positive output terminal of power supply 508 is electrically connected to the string. A second end of the string, fastened to a tuning pin 519 at the distal end of the neck, is held in place by a grounded conducting nut 510. The conducting nut 510 is electrically connected to a metal truss rod 512 which extends down the length of the neck 504. The truss rod provides mechanical support to the neck, while also providing a ground return path for the current on conductive string 506. An electrical conductor 520 connects the truss rod 512 to the ground terminal of power supply 508, thereby completing the circuit, and allowing a DC current to flow along the length of the string. The magnitude of the current need only be large enough to generate a strong enough magnetic field to be sensed by the GMR magnetic field gradient sensor.

In the above case, the strings may act as antennae and pickup stray electrical signals. The DC current can be replaced with an AC current whose frequency is well above the limits of human hearing, perhaps 100 KHz. The sensor output is then an Amplitude Modulated (AM) signal that can be demodulated with a simple AM detector, a diode and a low-pass filter.

Figure 6:
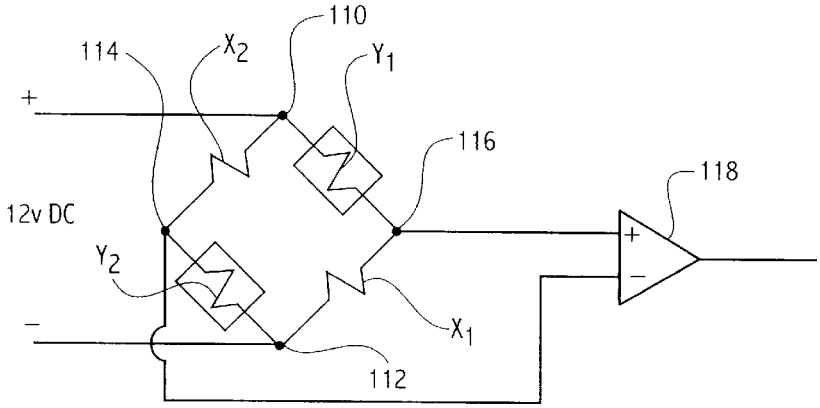
FIG. 6 is a schematic diagram of an electrical pickup according to another embodiment of the invention.

The present invention may also be practiced with magnetoresistive sensors other than the magnetic field gradient type just described. FIG. 6 shows a schematic diagram of an electrical pickup according to the present invention employing a GMR magnetic field (as opposed to a field gradient) sensor, such as theAA002–AA006 series magnetic field sensors also manufactured by Nonvolatile Electronics, Inc. The schematic diagram of FIG. 6 is nearly identical to that of FIG. 1. As with the GMR magnetic field gradient sensor, the GMR magnetic field sensor also comprises four GMR magnetoresistors $X_1$, $X_2$, $Y_1$ and $Y_2$ connected in a Wheatstone bridge configuration. However, in the GMR magnetic field sensor of FIG. 6, the $Y_1$ and $Y_2$ pair of resistors, comprising opposite legs of the Wheatstone bridge, is magnetically shielded so that their resistance is unaffected by changes in the external magnetic field. The remaining opposite legs of the Wheatstone bridge, resistors $X_1$, $X_2$, are unshielded, and so their resistance changes in relation to the strength of the external magnetic field.

Figure 7:
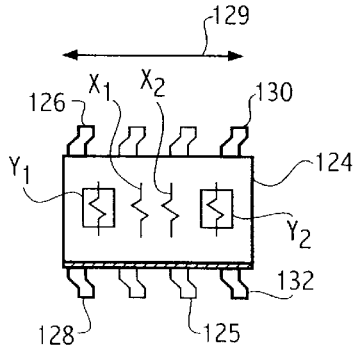
FIG. 7 is a plan view of a GMR magnetic field sensor used in the pickup of FIG. 6.

The physical layout of the GMR magnetic field sensor 124 is different from that of the GMR magnetic field gradient sensor previously discussed. As shown in FIG. 7, the unshielded resistors $X_1$, $X_2$, are positioned near the center of the sensor chip, with the shielded resistors $Y_1$, $Y_2$ located on either side. In this arrangement, the magnetic shields shielding the $Y_1$ and $Y_2$ resistors also act as flux concentrators, directing the external field toward the unshielded resistors $X_1$, $X_2$ along the sensor's axis of sensitivity. By concentrating the magnetic flux on the $X_1$, $X_2$ resistors, the sensitivity of the sensor is increased. The GMR magnetic field sensor detects the magnitude of external magnetic fields directed parallel to the sensor's axis of sensitivity 129. Furthermore, the sensor is unaffected by the direction of the external field. For example, the sensor shown in FIG. 7 will have the same output voltage for equal strength magnetic fields directed to the left or right of the sensor. As the strength of the external magnetic field varies, the resistance of the unshielded GMR resistors $X_1$, $X_2$ changes with changing magnitude of the external magnetic field, while the resistance of the shielded resistors $Y_1$, $Y_2$ remains constant. Thus, the wheatstone bridge becomes unbalanced, and the output voltage increases with increasing magnetic field strength regardless of field direction, thus giving rise to the uni-polar symmetry of the output curve shown in FIG. 9.

Figure 9:
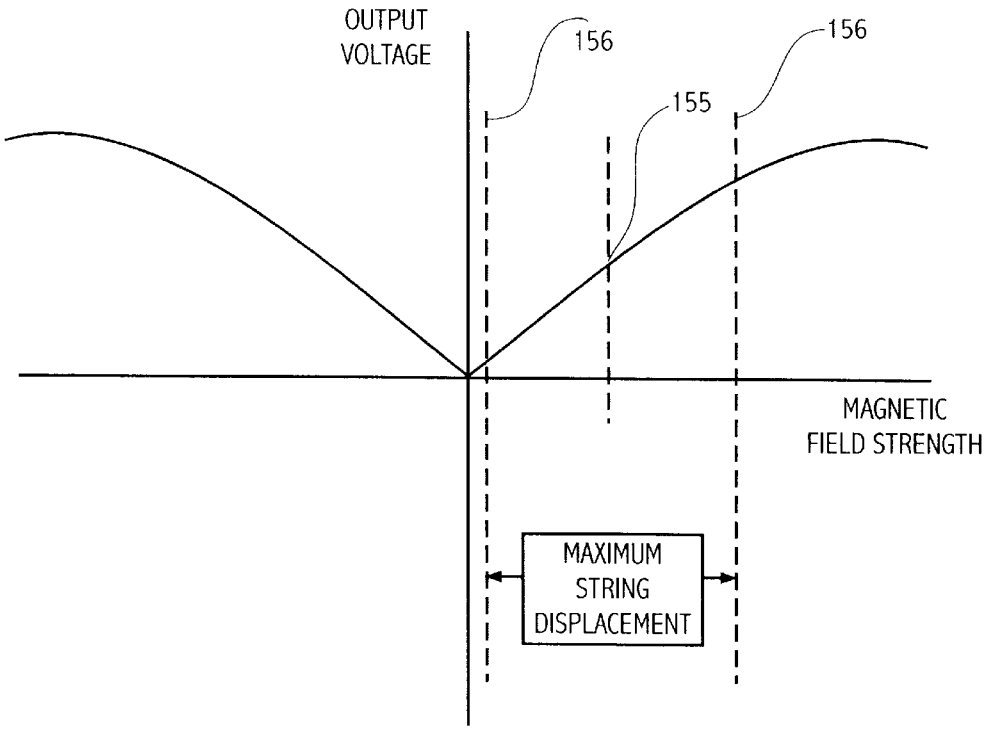
FIG. 9 is a graph showing the output characteristics of an electrical pickup according to the embodiment of FIG. 6.

As FIG. 9 shows, the voltage output characteristics of the magnetic field sensor include two separate linear regions on either side of the zero point. In order to employ the magnet field sensor as a pickup for a musical instrument, the sensor must be biased so that the magnitude of the external magnetic field remains within one of the linear portions of the curve, despite the variations in the external field caused by the vibrations of the string. This can be accomplished by placing a biasing magnet near the sensor with the magnetic poles aligned with the sensor's axis of sensitivity. When biased in this manner, the sensor continuously detects the presence of the bias field, and variations in the ambient magnetic field are registered at points on either side of the bias point, thus the point along the output curve corresponding to zero external field is shifted from the lowest point on the curve to a point 155 further up in the linear region on one side of the curve. On an electrical pickup for a stringed instrument, the zero field point 155 corresponds to the string's center of vibration. Once the sensor is properly biased, it must be placed on the instrument with the sensor's axis of symmetry oriented such that the vibratory motion of the string causes a corresponding change in the magnetic field parallel to the axis of sensitivity. In this arrangement, the sensor will behave as described in the previous embodiments, and the output voltage of the sensor will vary with displacement of the string, as seen in the output curve of FIG. 9. The voltage will always be positive, centered around the zero point 155. Once again, the physical parameters are selected so that the dashed lines 156 which represent the maximum vibratory displacement of the string in each direction are entirely within the linear response portion of the output curve.

A significant advantage of the electrical pickup of the present invention is that a separate pickup may be conveniently and inexpensively supplied for each individual string of a multi-stringed instrument such as a guitar, violin, or harp. By providing a separate electrical signal that accurately represents the instantaneous position of each individual string, the true acoustic sound of the instrument may be more accurately reproduced. Therefore, another aspect of the present invention is to provide an electric multi-stringed musical instrument having an individual electrical pickup applied to each string. This aspect of the invention may be practiced on any multi-stringed instrument, but it is particularly well suited for electric guitars. Therefore, the embodiments disclosed below are described as they relate to a six-string electric guitar, although they may also be practiced on other instruments having different numbers of strings.

Figure 10:
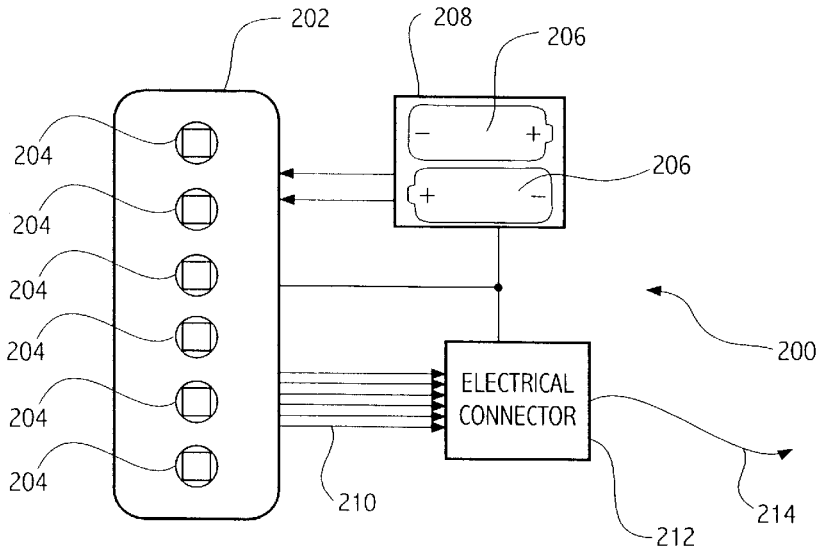
FIG. 10 is a block diagram of a musical instrument according to an embodiment of the invention.
Figure 11:
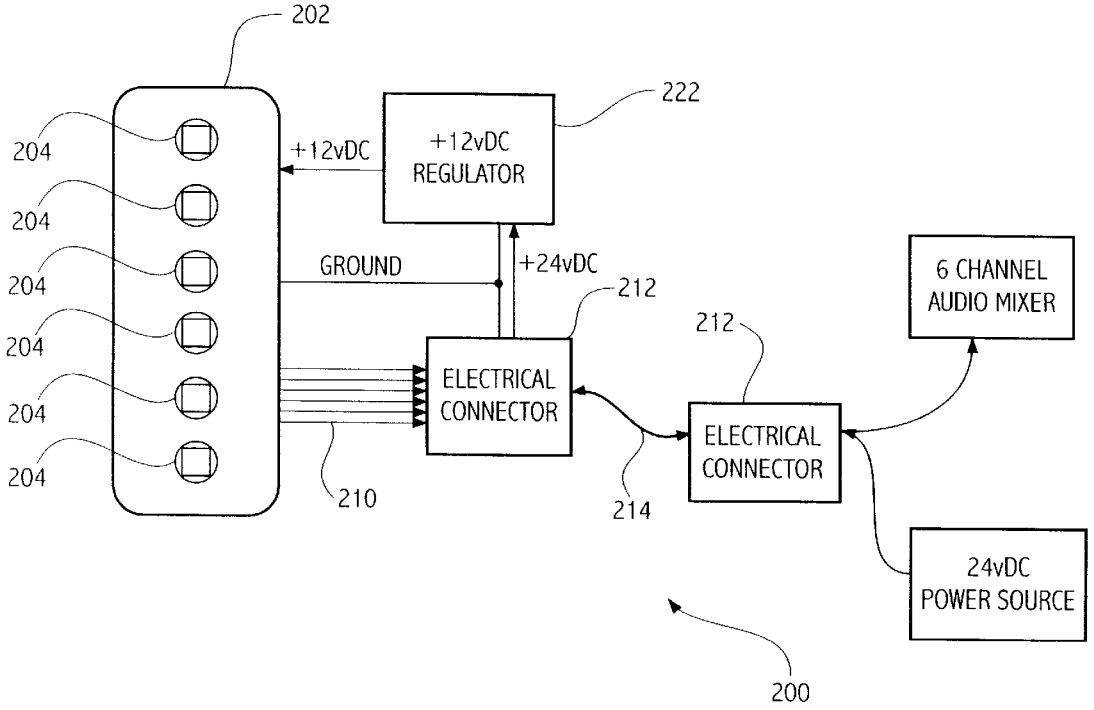
FIG. 11 is a block diagram of a musical instrument according to another embodiment of the invention.

Turning to FIG. 10, a block diagram of a six-string guitar employing individual string pickups according to the present invention is shown at 200. Guitar 200 includes GMR pickup assembly 202 which includes six GMR pickups 204, one for each string. The pickup assembly may comprise a flexible printed circuit board on which the individual pickups 204 are mounted. Since the bridge of the guitar is normally curved in a direction perpendicular to the long axis of the guitar, the flexible printed circuit board may then be mounted on a block having an arcuate surface of radius slightly smaller than the radius of the bridge of the guitar. Placing pickups on a curved surface in this manner allows each pickup to be approximately the same distance from its associated string when the assembly is mounted on the body of the guitar. A second printed circuit board may be optionally mounted below the first printed circuit board carrying the pickups, and individual gain potentiometers may be provided on the lower printed circuit board for independently setting the gain for the output signal of each string.

Power for operating the pickups and providing a DC current along the length of the strings, if necessary, is provided by batteries 206 stored in a battery holder 208 mounted on the instrument. Six independent output signals 210, one for each string, are provided from the pickup assembly and run directly to a multi-circuit electrical connector 212 provided to mate with an external cable 214. The cable 214 transmits the output signals from the individual strings to an external amplifier, a six channel mixer, or other recording/signal processing equipment.

Figure 13:
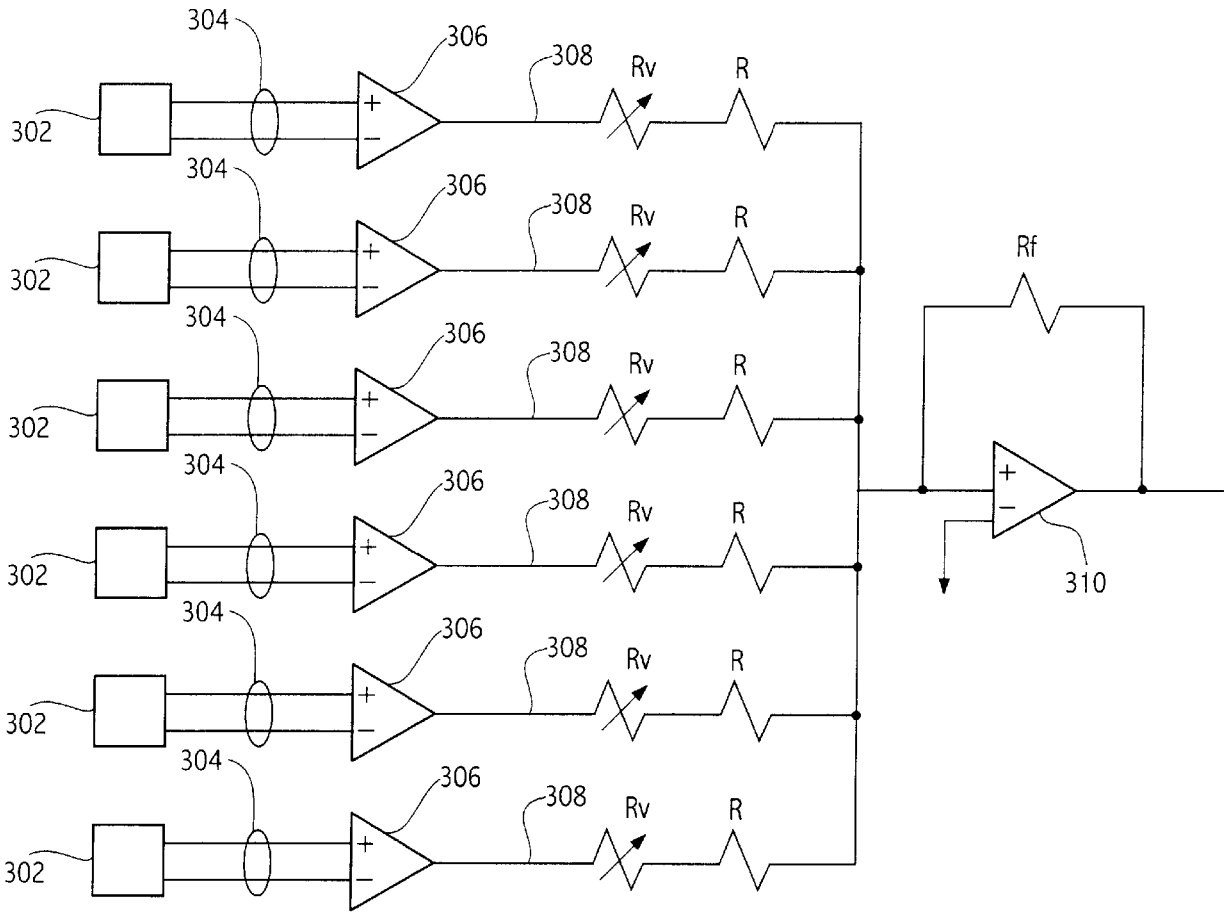
FIG. 13 is a schematic diagram of an output circuit wherein the gain from each pickup of a multi-stringed instrument may be individually adjusted.

A schematic diagram of an output circuit providing separate gain control for the output signal from each pickup is shown in FIG. 13. The GMR sensors of each pickup are shown as blocks 302, having output signals 304 connected to differential amplifiers 306. The output signal 308 from each differential amplifier is connected to a potentiometer RV and a fixed resistor R and finally connected as an input to summing amplifier 310. A feedback resistor RF is connected between the output of summing amplifier 310 and the input thereof. The gain for each individual string can be calculated by the formula:

$$G = \frac{RF}{R + Rv}$$

Thus the gain will decrease with increasing Rv. With the potentiometer set to 0 ohms for a particular string, gain will be maximized for that string. The gain may then be reduced by increasing the value of Rv.

An alternate embodiment of guitar 200 is shown in FIG. 10. Here the batteries and battery holder are eliminated, and instead power for operating the pickups 204 is supplied by an external power supply and conveyed to the guitar via an additional circuit incorporated within the external cable 214. In the embodiment shown, a 24v DC power source is provided. A DC regulator 222 is provided on the instrument to supply the proper voltages to the GMR sensors and output amplifiers for each pickup.

Figure 12:
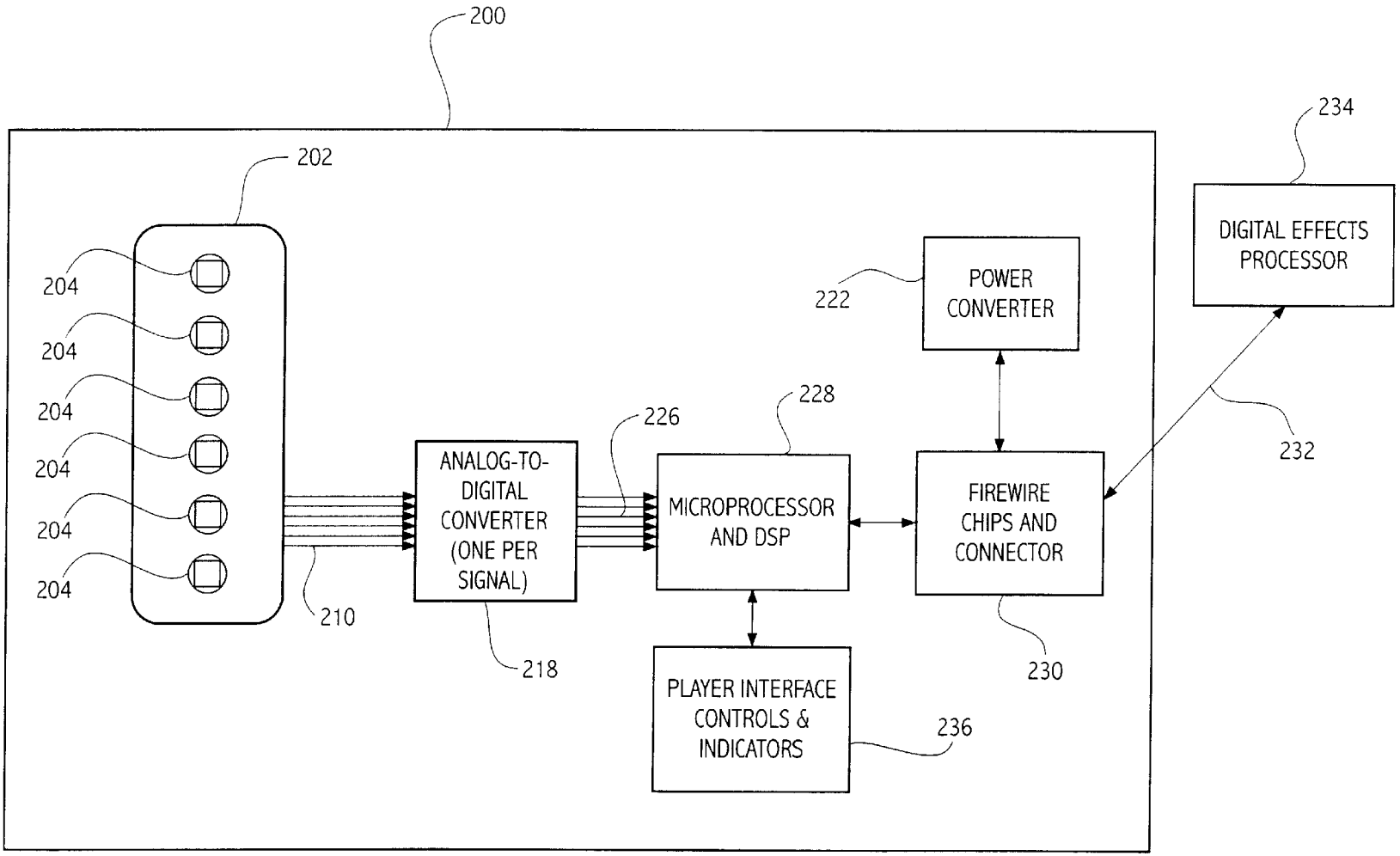
FIG. 12 is a block diagram of a musical instrument according to yet another embodiment of the invention.

Yet another embodiment of guitar 200 is shown in FIG. 12, incorporating more sophisticated electronics on the instrument itself. As with the previous embodiment, power is supplied to the instrument via an external cable 232, and a power converter 222 supplies the proper voltage levels to the various electronic components mounted on the guitar. A GMR pickup assembly 202 having a plurality of pickups 204 is provided to generate a separate analog voltage signal on respective conductors 210 for each string. Six analog-to-digital converters 218, one for each analog signal output from the pickup assembly, are provided for individually converting the respective analog signals into six individual digital signals. This embodiment can be applied to instruments with any number of strings.

The preferred digital format for each signal is a 32-bit word per sample as defined by the AES-3 standard of the Acoustical Engineering Society. Using the AES-3 format with the DVD encoding standard, 24 bit samples at sampling rates up to 192K samples per second may be encoded. Digitizing the signals at the guitar instead of at the other end of a connecting cable connecting the guitar to the external sound equipment eliminates noise that may otherwise interfere with analog signals transmitted over the cable. Thus, the true sound of the strings may be more faithfully recorded or reproduced by downstream audio equipment.

The digitized signals 226 are input to a microprocessor 228 onboard the guitar. The microprocessor may be used to provide individual gain control and equalization of the independent pickup signals. The microprocessor further uses Time Division Multiplexing (TDM) to combine the separate digital signals into a single digital signal that may be serially transmitted over a high speed digital data link. In the preferred embodiment of the invention, the digital data link employs IEEE standard 1394 or 1394a, commonly known as "FireWire". Microprocessor 228 outputs the single TDM signal to a FireWire chip set and connector 230, the chip set being adapted to implement the Fire Wire protocol. The FireWire chip set and connector 230 transmit the signal from the guitar over a specially adapted FireWire cable 232. (As previously noted, cable 232 also conveys power to the guitar.) The data rates of the analog-to-digital converters described above correspond to 768 KBytes per second. This translates to 36,864 Mbits per second for a six string instrument, which is a mere 10% of the 400 Mbit per second capacity of FireWire. While the FireWire protocol is preferred, other digital data transmission links capable of transmitting sufficient data to recreate the signals for each string in real time may also be used.

Outside the guitar, the cable may be connected to a digital effects processor 234 which demodulates the TDM signal and can individually manipulate the separate digital signals corresponding to each string. The guitar 200 itself may also include an interface 236 whereby the musician playing the instrument can control the remote digital effects processor 234. The control interface communicates with the microprocessor 228 which encodes the interface control signals with the data signals transmitted over the data link to the digital effects processor. In this way, a musician playing the guitar may select various sound effects to be added to the output of the guitar, by manipulating an interface control directly from the guitar 200. For example, on a first song the musician may want the guitar to have a more acoustic sound, then on the next song he may wish to switch to a more "electric" sound, such as that developed on guitars using conventional pickups which introduce their own sonic qualities. Thus, the musician may seamlessly transition from a more delicate acoustic sound on softer, quieter songs, to a harder-edged distorted sound on full volume rock 'n roll anthems, all without switching guitars.

Various changes and modifications to the present invention may be made by those of ordinary skill in the art without departing from the spirit and scope of the present invention, which is set out in more particular detail in the appended claims. Furthermore, those skilled in the art will appreciate that the foregoing description is by way of example only, and is not intended to limited the invention as set forth in such claims.

What is claimed is:

1. A transducer for use with a stringed instrument, said transducer generating an electrical signal corresponding to movement of a vibrating string as the instrument is played, the transducer comprising:

a plurality of magnetoresistive elements, each having an electrical resistance that varies in response to a parameter of a magnetic field;

said plurality of magnetoresistive elements electrically connected in a Wheatstone bridge configuration having a pair of input terminals and a pair of output terminals;

a first pair of said magnetoresistive elements corresponding to a first pair of opposite legs of said Wheatstone bridge and being physically located on a first side of said string, and a second pair of said magnetoresistive elements corresponding to a second pair of opposite legs of said Wheatstone bridge and being physically located on a second side of the string; and means for generating a magnetic field adapted to interact with said magnetoresistive elements such that perturbations in the magnetic field caused by movement of the string alter the resistance of at least some of said magnetoresistive elements whereby, when a voltage is applied across the input terminals of said Wheatstone bridge, an output signal that varies with the changing resistance of said magnetoresistive elements is developed across the output terminals.

2. The transducer of claim 1 wherein said means for generating a magnetic field comprises a permanent magnet, said Wheatstone bridge being disposed between said magnet and string.

3. The transducer of claim 1 further comprising a pole piece attached to said magnet adapted to concentrate the magnetic field of said magnet in the area of the Wheatstone bridge and the string.

4. The transducer of claim 1 wherein said means for generating a magnetic field comprises an electrical current running along the length of said string.

5. The transducer of claim 1 wherein said means for generating a magnetic field comprises a magnetized ferromagnetic string.

6. The transducer of claim 1 wherein said magnetoresistive elements comprise thin film giant magnetoresistive resistors.

7. An electrical musical instrument comprising:

a support having an electrically conductive string stretched taut thereacross, said string being adapted to vibrate when acted upon by a musician; and an electrical pickup for sensing the vibration of the string, said pickup comprising;

first and second magnetoresistive elements located on a first side of said string, and third and fourth magnetoresistive elements located on a second side of said string, said magnetoresistive elements being electrically connected in a Wheatstone bridge configuration;

a first DC input terminal formed at a junction between said first and second magnetoresistive elements and a second DC input terminal formed at a junction between said third and fourth magnetoresistive elements;

a first output terminal formed at a junction between said first and third magnetoresistive elements and a second output terminal formed at a junction between said second and fourth magnetoresistive elements;

a DC voltage source providing a DC voltage across said first and second DC input terminals;

means for creating a magnetic field oriented to interact with said magnetoresistive elements, such that vibration of said string causes perturbations in said magnetic field, said perturbations causing the resistance of said magnetoresistive elements to change, thereby generating an output signal across said output terminals corresponding to the position of the vibrating string; and an output amplifier for amplifying said output signal.

8. The musical instrument of claim 7 further comprising a plurality of said strings and a plurality said pickups whereby a separate output signal is generated corresponding to the vibration of each string.

9. The musical instrument of claim 8 wherein the pickups are mounted substantially equal distances from their associated strings.

10. The musical instrument of claim 8 further comprising an electrical connector containing a plurality of circuits sufficient to connect each of said output signals to an external cable for connecting said instrument to external signal processing equipment.

11. The musical instrument of claim 8 further comprising a summing amplifier, the output signal from each of said plurality of pickups being input to said summing amplifier to produce a single composite signal representing the vibration of each of said strings.

12. The musical instrument of claim 11 further comprising a plurality of potentiometers each connected between the output of one said pickups and said amplifier whereby the gain of the summing amplifier may be separately adjusted for each string.

13. The musical instrument of claim 8 further comprising a plurality of analog-to-digital converters, each associated with one of said output signals to produce a separate digital signal corresponding to the vibration of one of said plurality of strings.

14. The musical instrument of claim 13 further comprising a microprocessor providing digital signal processing of said separate digital signals such that each signal may be individually manipulated.

15. The musical instrument of claim 14 further comprising a digital effects processor and interface controls, said interface controls being mounted on said instrument so that a musician while playing said instrument may readily interact with said digital effects processor to select various predefined sound effects provided by said digital effects processor, said digital effects processor manipulating said digital signals to implement said sound effects.

16. The musical instrument of claim 7 wherein said means for providing a magnetic field comprises a permanent magnet mounted on said support behind said magnetoresistive elements, said magnetoresistive elements being mounted between said magnet and said string.

17. The musical instrument of claim 16 further comprising a pole piece attached to said permanent magnet whereby magnetic flux lines from said magnet are concentrated on said magnetoresistive elements.

18. The musical instrument of claim 7 wherein the means for creating a magnetic field comprises an electrical current running along the length of the string.

19. The musical instrument of claim 7 wherein the means for creating a magnetic field comprises a magnetized string.

20. An improved stringed instrument having a plurality of strings adapted to vibrate when acted upon by a musician, the improved instrument comprising:

respective magnetoresistive electrical pickups for each of the strings on the instrument, said pickups positioned to individually sense the vibration of their respective strings and generate an electrical signal corresponding to the vibration thereof; and means for individually transmitting each of said electrical signals from the instrument to external sound processing equipment.

21. The instrument of claim 20 further comprising analog-to-digital converter means acting to convert an analog output signal from each of said pickups into a digital signal.

22. The instrument of claim 21 wherein said transmitting means comprises a serial digital communications link.

23. The instrument of claim 20 further comprising a summing amplifier, the electrical signal generated by each pickup being connected as an input to said summing amplifier, said summing amplifier providing a single composite signal combining each of said electrical signals generated by said plurality of pickups for transmission from the instrument.

24. The instrument of claim 20 wherein each pickup comprises:

a Wheatstone bridge comprising a plurality of magnetoresistive elements having an electrical resistance that varies with a parameter of a magnetic field, first and second magnetoresistive elements forming a first pair of opposite legs of said bridge and physically located on a first side of the string with which said pickup is associated, and second and third magnetoresistive elements forming a second pair of opposite legs of said bridge and physically located on a second side of the associated string, said Wheatstone bridge having a pair of input terminals and a pair of output terminals;

a DC voltage source connected across said input terminals;

and means for generating a magnetic field adapted to interact with said magnetoresistive elements such that perturbations in the magnetic field caused by movement of the string alters the resistance of at least some of said magnetoresistive elements and an output voltage signal developed across said output terminals varies with movement of said string.

25. The musical instrument of claim 24 wherein said means for providing a magnetic field comprises a permanent magnet mounted behind said Wheatstone bridge, said magnetoresistive elements being mounted between said magnet and said string.

26. The musical instrument of claim 25 further comprising a pole piece attached to said permanent magnet whereby magnetic flux lines from said magnet are concentrated on said magnetoresistive elements.

27. The musical instrument of claim 24 wherein the means for creating a magnetic field comprises an electrical current running along the length of the string.

28. The musical instrument of claim 24 wherein the means for creating a magnetic field comprises a magnetized string.

29. The musical instrument of claim 20 wherein said magnetoresistive pickups comprise a GMR magnetic field gradient sensor.

30. The musical instrument of claim 20 wherein said magnetoresistive pickups comprise a GMR magnetic field sensor.

* * * * *